US005431374A

United States Patent [19]

Janssen et al.

[11] Patent Number: 5,431,374

[45] Date of Patent: Jul. 11, 1995

[54] NOZZLE AND BASE PLATE APPARATUS AND METHOD FOR USE IN A TUNDISH SLIDE GATE VALVE

[75] Inventors: Dominique Janssen, Tyler; Jon Bell, Whitehouse, both of Tex.; Dave Moore, Rantoul, Ill.; Bruce Winter; George Sundy, both of Mahomet, Ill.; Alan J. Engel, Sr., Sewickley, Pa.

[73] Assignee: Vesuvius Crucible Company, Wilmington, Del.

[21] Appl. No.: 143,112

[22] Filed: Oct. 29, 1993

[51] Int. Cl.[6] ..... B22D 41/42; B22D 41/58

[52] U.S. Cl. ..... 266/45; 266/220; 266/236; 222/600; 222/603

[58] Field of Search ..... 222/600, 603, 590; 266/236, 220, 45

[56] References Cited

U.S. PATENT DOCUMENTS

| | | | |
|---|---|---|---|
| 3,773,226 | 11/1973 | Kutzer | 222/603 |
| 3,779,431 | 12/1973 | Tinnes et al. | 222/600 |
| 4,076,153 | 2/1978 | Tinnes | 222/600 |
| 4,076,154 | 2/1978 | Tinnes | 222/600 |
| 4,756,452 | 7/1988 | Tsukamoto et al. | 222/603 |
| 5,004,131 | 4/1991 | Russo | 222/600 |
| 5,137,189 | 8/1992 | Hall et al. | 266/220 |
| 5,284,278 | 2/1994 | Waltensuhl | 222/603 |

FOREIGN PATENT DOCUMENTS 328975 4/1991 Japan .

515967 1/1993 Japan .

*Primary Examiner*—Scott Kastler

*Attorney, Agent, or Firm*—Sixbey, Friedman, Leedom & Ferguson

[57] ABSTRACT

A unitized nozzle and top plate assembly for use in a slide gate valve is disclosed which comprises a nozzle having porous, gas permeable walls, a top plate having an opening through its thickness for regulating a flow of molten metal, such as steel, and a recess circumscribing the opening for receiving and securing the discharge end of the nozzle to the top plate. The depth of the recess is at least 50%, and preferably 70–80% of the thickness of the top plate in order to minimize the contact between molten metal and the surface of the top plate opening, which in turn reduces the amount of flow-obstructing alumina deposits which accumulate in this area of the slide gate valve. To prevent leaks from occurring in the system supplying pressurized argon through the porous nozzle walls, the gas coupling that is normally welded directly to the steel can surrounding the nozzle is instead mounted on the end of a steel pipe connected to the can. The thermal resistance of the steel pipe substantially reduces the temperature that the coupling is exposed to. The invention also encompasses a method for facilitating the assembly and maintenance of the slide gate valve by the use of the unitized nozzle and top plate in lieu of the in situ mounting of such a nozzle on a top plate already installed in such a valve.

26 Claims, 4 Drawing Sheets

1
48a
48b
30
46
48c
72
71
32
60
56
62
64
3
66
42
34
44
40
41
99
103
101
96
97
98
88b
89
95
95.6
91
93
95.5
54
52
50
82
81
79
83
85
87
71
88a
77

NOZZLE AND BASE PLATE APPARATUS AND METHOD FOR USE IN A TUNDISH SLIDE GATE VALVE

BACKGROUND OF THE INVENTION

This invention generally relates to tundish slide gate valves used to regulate a flow of molten steel, and is specifically concerned with a unitized porous nozzle and top plate for use in such a valve.

Porous nozzles for use in tundish slide gate valves are well known in the prior art. The walls of such nozzles are formed from a porous, gas permeable refractory material which may be a ceramic oxide of aluminum, silicon, magnesium, chromium, or zirconium, or mixtures thereof. The inside surface of the nozzle walls defines a bore for conducting a flow of liquid metal such as steel. The outside surface of these nozzles is enveloped in a "can" of metallic sheet material, such as steel, that is spaced apart from the outside nozzle surface in order to define one or more annular, gas conducting spaces.

Such prior art nozzles are installed within the nozzle well of a tundish. A metal jig is used to position the discharge end of the nozzle in alignment over a circular opening in a top plate. A high temperature gasket is placed between the bottom flat surface of the discharge end of the nozzle and a circular area around the top plate opening prior to the positioning of the top plate under the nozzle to join and seal the nozzle bore in registry with the top plate opening. The top plate overlies a slidable throttle plate having a circular opening that is registrable with the circular opening in the top plate to modulate the flow of steel in gate valve fashion.

In operation, pressurized inert gas is permeated through the annular space between the outside surface of the nozzle and the steel can that circumscribes it while molten metal flows through the bore of the nozzle. The inert gas flows through the porous nozzle walls, and advantageously forms a fluid film over the surface of the bore within the nozzle that prevents that molten metal from making direct contact with the inner surface forming the bore. By insulating the bore surface from the molten metal, the fluid film of gas prevents the small amounts of alumina that are present in such steel from sticking to and accumulating onto the surface of the nozzle bore. The prevention of such alumina deposits is important, as such deposits will ultimately obstruct the flow of molten steel until it congeals around the walls of the bore, thereby clogging the nozzle. Such a clogged nozzle necessitates the shutting down of the slide gate valve and the replacement of the nozzle.

While such porous nozzles have generally shown themselves to be effective in retarding the accumulation of bore-obstructing alumina deposits, the inventors have observed a number of shortcomings associated with such nozzles which have prevented them from realizing their full potential. For example, while the inert gas permeates through the porous walls of such nozzles is effective in retarding alumina deposits on the surface of the nozzle bore itself, none of the argon gas forms any kind of effective, deposit-retarding film on the surface of the opening in the top plate of the valve. Consequently, alumina deposits are apt to form around the surface of the circular discharge opening in the top plate, which can ultimately lead to valve obstruction. Still another shortcoming follows from the mounting of the inert gas coupling assembly directly in the steel can that circumscribes the outer surface of nozzles. The female portion of the coupling assembly that is typically welded on the steel can of the nozzle can attain temperatures of up to 1800° F., causing it to expand relative to the male portion of the coupling to an extent where a major gas leak can result. Such a leak can jeopardize the function of the gas in penetrating the nozzle walls and forming a protective fluid film over the surface of the nozzle bore, as the pressure of the inert gas must be maintained at a level high enough to overcome the considerable back-pressure that the molten steel applies to the surface of the bore. Ideally, the gas pressure should be just enough to form the desired film. If it is too high, the gas can stir the steel excessively, thus creating additional defects. Thus the control of the gas pressure and flow is critical, and must be maintained within a narrow range. Any significant leak can jeopardize the desired delicate pressure balance. Other shortcomings of prior art nozzles occur as a result from the in situ formation of the butt joint between the flat bottom surface of the discharge end of the nozzle, and the area surrounding the flow opening in the top plate. The metal jigs used to position and align the nozzle over the top plate can warp, leading to misalignments. Moreover, the fact that the positioning of the nozzle over the top plate is performed in situ between the tundish and the throttle plate, generally makes the installation process clumsy, inconvenient, and time consuming. Finally, the resulting misalignments that can occur between the nozzle and the top plate can result in uneven pressure on the material forming the gasket between these components. Such uneven pressure can result in large variations in gasket thickness, which in turn can lead to a gasket failure and a consequent break-out of steel, or unwanted raising of the nozzle.

Clearly, there is a need for an improved kind of nozzle mechanism that prevents or at least minimizes the accumulation of alumina deposits on the nozzle bore, and prevents gas leaks from occurring in the gas coupling leading to the nozzle can. Ideally, such an improved nozzle mechanism could be easily and quickly installed in a tundish slide gate valve without the need for jigs or other alignment mechanisms, and further without the need for the formation of an in situ gasket. Finally, it would be desirable if such an improved nozzle assembly were reliable, durable, and relatively inexpensive to manufacture.

SUMMARY OF THE INVENTION

Generally speaking, the invention is a gas conducting nozzle and top plate assembly for use in a slide gate valve that obviates or at least ameliorates all the aforementioned shortcomings associated with the prior art. The invention comprises a nozzle having walls formed substantially from a porous, gas permeable refractory material having a receiving end and a discharge end for receiving and discharging molten metal, and a top plate means having an opening through its thickness that defines a control edge for regulating a flow of molten metal. A recess circumscribes the top plate opening for receiving and securing the discharge end of the nozzle to the top plate. The depth of the recess is at least 50%, and more preferably 70–80% of the thickness of the top plate. The positioning of the discharge end of the nozzle through most of the thickness of the top plate by means of the recess minimizes contact between molten metal flowing out of the discharge end of the nozzle and the surface of the opening in the top plate, thereby reducing the opportunity for deposits of flow-obstructing alumina to accumulate in this area of the slide gate mechanism.

The invention may further include a system for providing pressurized inert gas through the walls of the nozzle that includes a conduit, which may take the form of a steel pipe, having one end welded to the can of sheet steel that surrounds the nozzle walls, and another end including a coupling for connecting the pipe to another pipe leading to a source of pressurized inert gas, wherein the length and thermal resistance of the pipe creates a protective thermal gradient between the sheet steel surrounding the nozzle, and the coupling. For example, in applications where the sheet steel surrounding the nozzle reaches temperatures of approximately 1800° F., the steel pipe forming the conduit should be sufficiently long so that the coupling present on its outer end only sees a temperature of approximately 600° to 800° F. The thermal resistance provided by such a pipe prevents the coupling from being exposed to temperatures which can result in significant gas leakages.

The pressurized gas system may also include a second conduit and set of passageways for surrounding the interface between the top plate and the throttle plate located underneath it with a positive pressure of inert gas which advantageously prevents molten metal flowing out of the top plate opening from being exposed to ambient oxygen. The passageways which provide inert gas to this region of the slide gate mechanism may include a bore that communicates with a second gas conduit at one end, and which communicates with the bottom surface of the top plate at its opposite end. This gas conducting bore may in turn communicate with a first C-shaped groove that partially circumscribes the opening on the bottom surface of the top plate, and a second overlapping C-shaped groove in opposition to the first which partially circumscribes the flow-controlling opening in the throttle plate of the slide gate mechanism directly beneath the top plate.

The nozzle may include an annular shoulder on its discharge end for extending the length of the porous walls toward the lower surface of the top plate. In the preferred embodiment, the outside walls of this annular shoulder are covered by a terminal edge of the aforementioned steel sheet material. This edge of the steel sheet material is in turn fluidly and mechanically connected to the recess surrounding the opening in the top plate by means of a high temperature sealant. In the preferred embodiment, the top plate includes an insert through which the aforementioned opening is provided. The insert is preferably made from an erosion-resistant refractory material, such as zirconia. The presence of such an insert allows the balance of the top plate to be formed from a less costly refractory material, such as alumina.

The invention further encompasses a method for assembling a gas permeable nozzle and a top plate within a tundish slide gate mechanism. In the method of the invention, a recess is formed around the opening in the aforementioned top plate that is complementary in shape to the discharge end of the nozzle, wherein the recess has a depth of at least 50%, and preferably 70–80% of the thickness of the top plate. Next, the discharge end of the nozzle is fluidly sealed and mechanically joined to the surface of the recess by means of a refractory mortar or high temperature sealant, which joins these two components. Finally, the unitized nozzle and top plate is installed into a tundish slide gate valve. The method of the invention obviates the need for aligning and sealing a nozzle over a top plate that is inconveniently located within a slide gate valve.

BRIEF DESCRIPTION OF THE SEVERAL FIGURES

DETAILED DESCRIPTION OF THE PREFERRED EMBODIMENT

Figure 1:
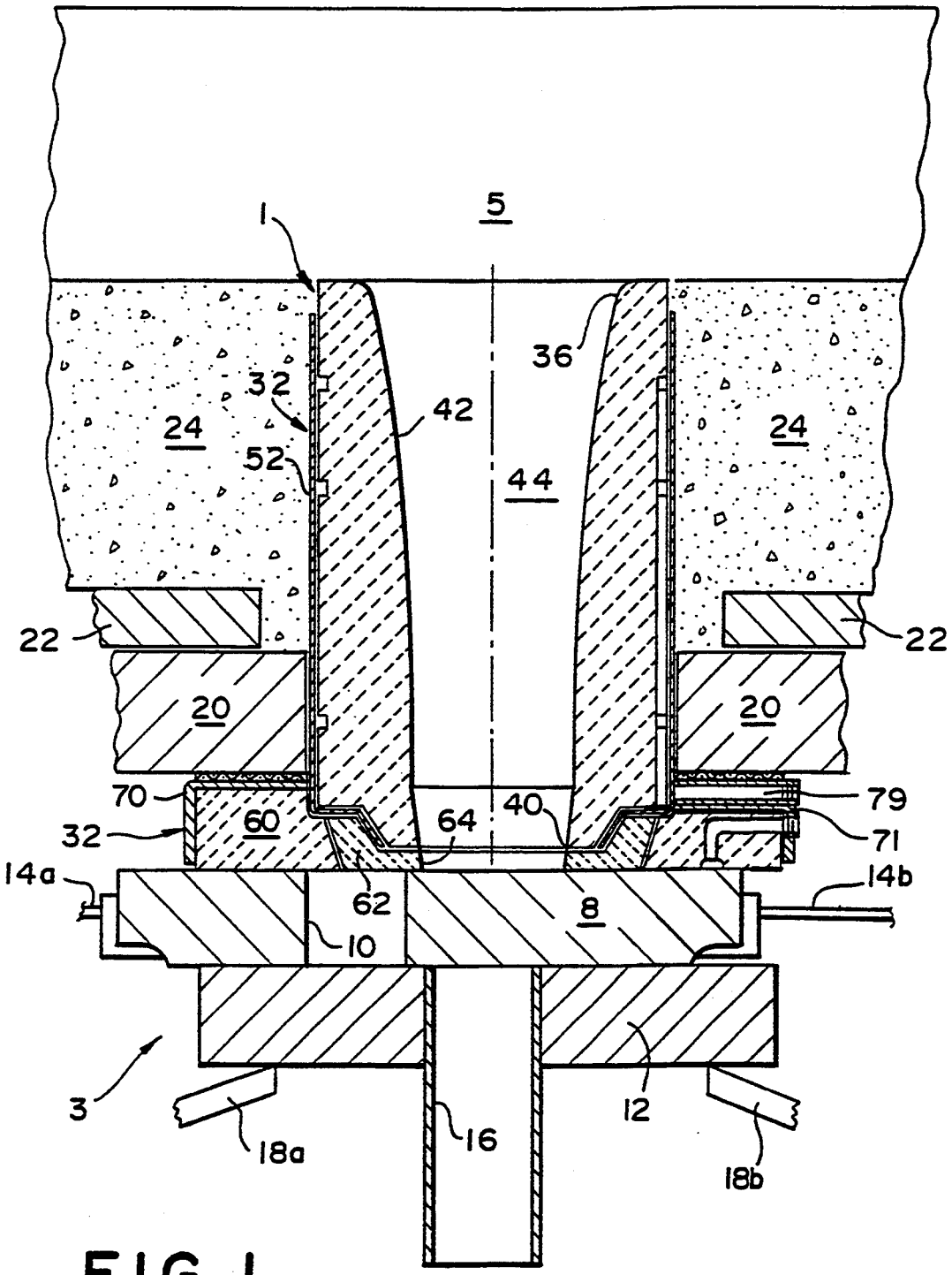
FIG. 1 is a side, cross-sectional view of the unitized nozzle and top plate assembly of the invention, illustrating how it fits into a tundish slide gate valve.

With reference now to FIG. 1, wherein like numerals designate like components throughout all the several figures, the unitized nozzle and top plate assembly 1 of the invention forms part of a slide gate valve 3 of a tundish 5. The tundish 5 holds a reservoir of liquid steel, and the slide gate valve 3 controls the flow of the liquid steel out of the tundish 5. To this end, the slide gate valve 3 includes a throttle plate 8 disposed under the assembly 1 that is formed from a refractory material. The throttle plate 8 includes a circular throttle opening 10 that forms one of the two control surfaces in the valve 3. The throttle plate 8 overlies a tube holder plate 12 which is likewise formed from a refractory material. The throttle plate 8 is slidably moveable with respect to both the discharge end of the unitized nozzle and top plate assembly 1 and the tube 16 of the tube holder plate 12 by means of piston rods 14*a, b* attached to hydraulic cylinders (not shown). The rate of flow of molten steel from the discharge end of the unitized nozzle and top plate assembly 1 through the tube 16 of plate 12 is, of course, dependent upon the degree of registry between the throttle opening 10 of the throttle plate 8 and the discharge and of the nozzle and top plate assembly 1 and the tube 16. Rockers 18*a, b* (only partially shown) exert an upward pressure against the underside of the tube holder plate 12 which supports the tube holder plate 12, the throttle plate 8, and the unitized nozzle and top plate assembly 1 firmly against the underside of the mounting plate 20 as shown. The vertical force applied by the rockers 18*a, b* further has the effect of creating a seal between adjacent surfaces of the throttle plate 8, the unitized nozzle and top plate assembly 1 and the tube holder plate 12. The seal created between these adjacent surfaces prevents molten steel from running between these three components during the operation of the slide gate valve 3. The middle and upper portion of the unitized nozzle and top plate assembly 1 extends through an opening in the tundish shell 22 and terminates at the floor of the tundish 5 in drain-like fashion. The upper portion of the nozzle and top plate assembly 1 is surrounded by heat resistant, particulate ramming material 24 which acts as a kind of caulking between the outer surface of the nozzle and top plate assembly 1 and the bottom wall of the tundish (not shown).

Figure 2:
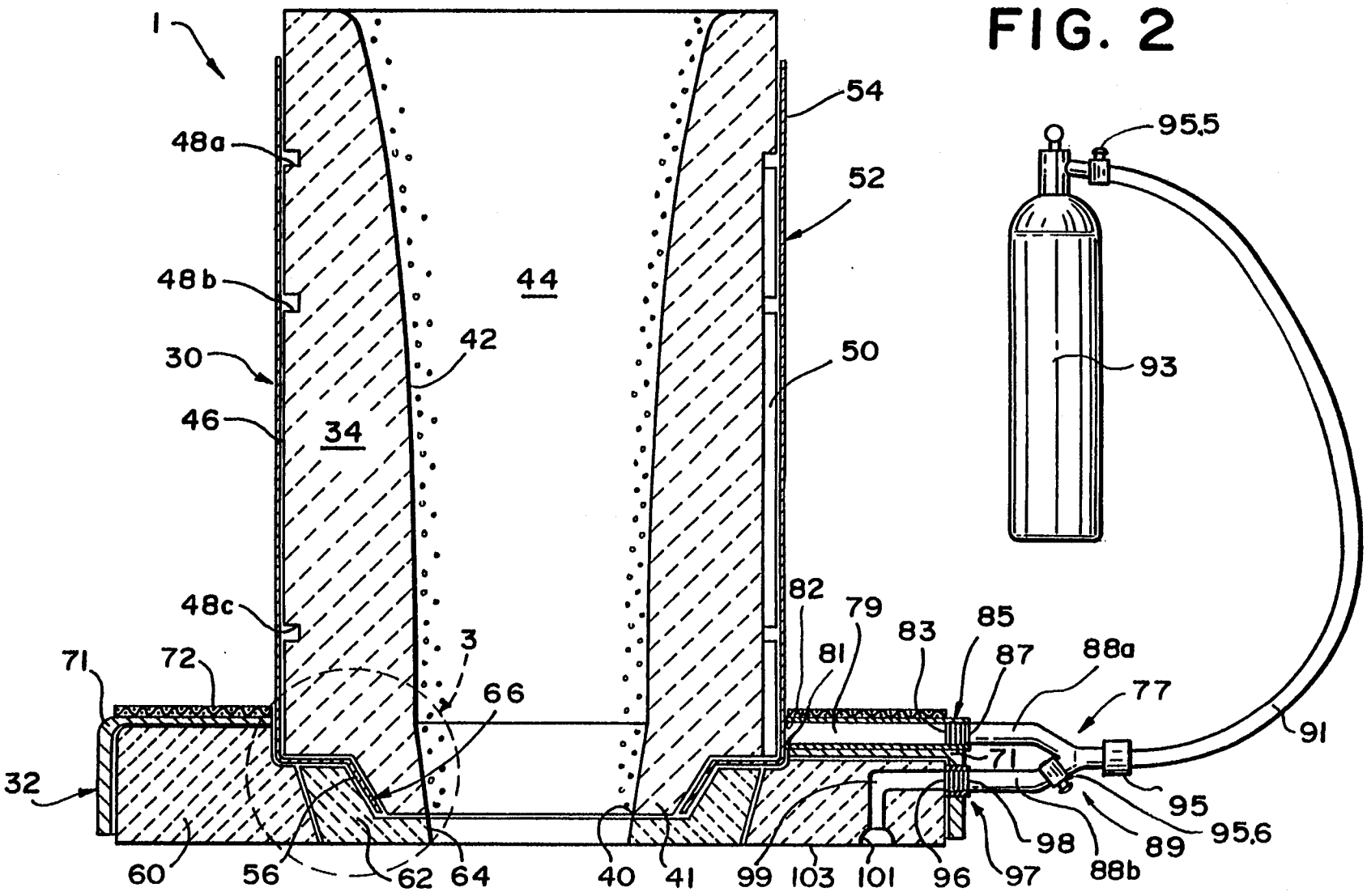
FIG. 2 is an enlarged side, cross-sectional view of the nozzle and top plate assembly of the invention, schematically illustrating how the pressurized inner gas source and bifurcated coupling that supplies inert gas to both the nozzle and the top plate of the assembly.

With reference now to FIG. 2, the nozzle and top plate assembly 1 includes a nozzle 30 whose bottom portion has been secured into a recess present in the top plate assembly 32. The walls 34 of the nozzle 30 are porous in order to render them permeable to the passage of an inert gas such as argon. In the preferred embodiment, the walls 34 are formed from porous magnesia, although ceramic oxides of aluminum, silicon, chromium, or zirconium, or a mixture of these oxides could be used as well. The porosity of the refractory material forming the walls 34 may be between 20% and 35% and the permeability between 50 and 1,500 centidarcys. The nozzle 30 has a receiving end 36 that terminates at the floor of the tundish 5 and a discharge end 40 which is concentrically aligned with the tube 16 of the tube holder plate 12. The discharge end 40 includes an annular shoulder 41 which downwardly extends the porous walls 34 of the nozzle 30. The inner surface 42 of the walls 34 defines a bore 44 having an elliptical profile for minimizing turbulence in the flow of molten steel that passes therethrough. The outer surface 46 of the walls 34 includes a plurality of circumferential, gas-conducting grooves 48*a, b, c* as shown. These grooves 48*a, b, c* are mutually inter-connected by means of a vertical groove 50. The entire outer wall surface 46 is covered by a tubular, can-like wall 52 formed from steel. The upper portion 54 of the tubular steel wall 52 circumscribes and is sealingly connected to an upper portion of the outer surface 46 of the nozzle walls 34 by means of a heat-resistant sealing material. The lower portion 56 of the tubular steel wall 52 circumscribes both the annular shoulder 41 and lower end of the nozzle walls 34 and is likewise sealed thereto by a layer 58 of refractory mortar. As will be described in detail hereinafter, the fact that the upper and lower portions 54, 56 of the tubular steel wall 52 are sealed around the upper and lower outer wall surfaces 46 of the nozzle walls 34 confines the flow of pressurized inert gas admitted through the steel wall 52 to the vertical groove 50 and around the annular grooves 48*a, b,* and *c* and from thence in a generally radial path through the porous walls 34 where it eventually bubbles out of the bore 44 defined by the inner wall surface 42.

Figure 3:
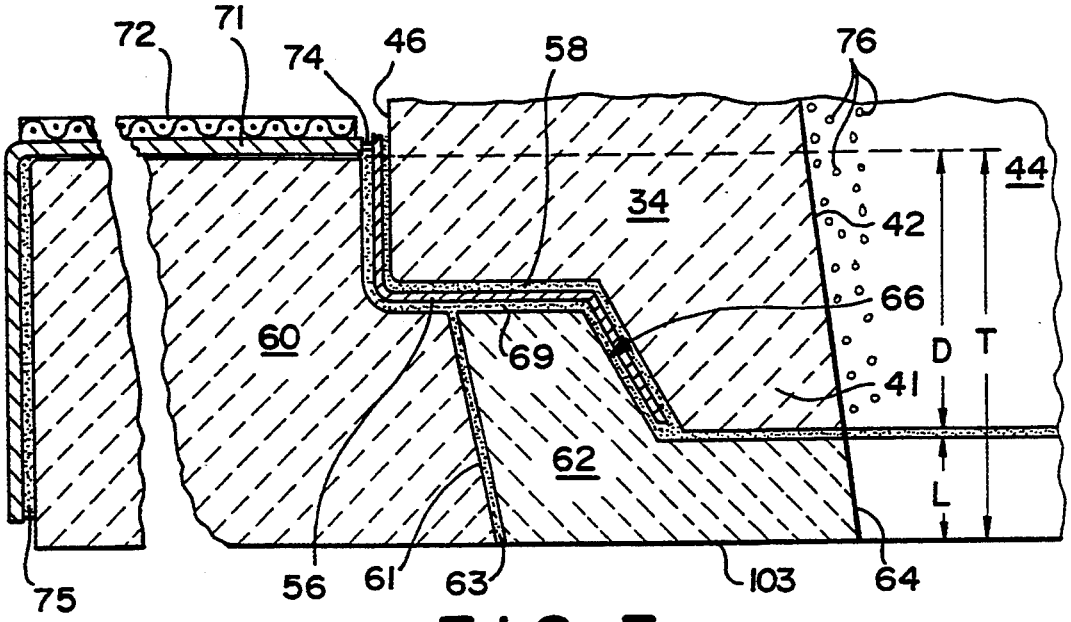
FIG. 3 is an enlargement of the area surrounded by the dotted circle in FIG. 2.
Figure 4:
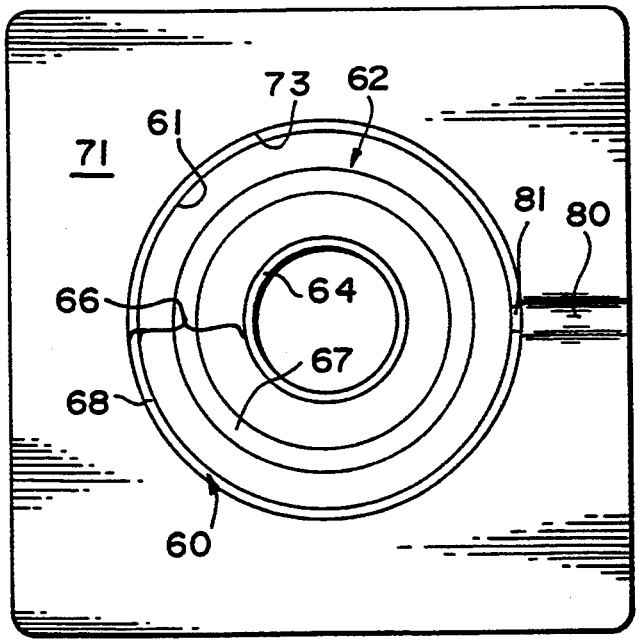
FIG. 4 is a top plan view of the top plate assembly of the invention with the nozzle removed in order to make the nozzle-receiving recess in the plate more plainly visible.

With reference now to FIGS. 2 and 3, the top plate assembly 32 comprises a rectangular plate 60 of refractory material, which is preferably alumina. This top plate 60 has a frusto-conical opening 61 in its central portion which receives a complimentarily-shaped insert 62 formed from a refractory material more erosion resistant to the effects of molten steel, such as zirconia. The insert 62 is secured into the frusto-conical opening 61 by means of a layer 63 of refractory mortar. Concentrically disposed in the center of the insert 63 is a discharge opening 64 that is sized to smoothly lead into the bore 44 at the discharge end 40 of the nozzle 30. The top plate 60 includes a recess 66 formed from a counterbore 67 in the insert 62 as well as an annular space 68 in the top plate 60 whose bottom surface is flush with the top surface of the insert 62 (as is best seen in FIG. 4). This recess 66 is complimentary in shape to the annular shoulder 41 and the outer surface of the discharge end 40 of the nozzle 30 and is secured therein in gas-tight relationship by means of a further layer 69 of refractory mortar. The outer top surface of the top plate 60 is covered by a layer of steel sheathing 71. A layer of refractory cloth 72 overlies the steel sheathing 71 in order to compensate for any irregularities between the top surface of the sheathing 71 and the bottom surface of the mounting plate 20 under the tundish 5 when the unitized nozzle and top plate assembly 1 is mounted into the position illustrated in FIG. 1. The steel sheathing 71 includes an annular opening 73 for admitting the canned nozzle 30 into the recess 66 in the top plate 60. The inner edge of the annular opening 73 of the sheathing 71 and the outer surface of the tubular steel wall 52 surrounding the nozzle 30 are interconnected by, for example, a plurality of tack welds 74, only one of which is shown in FIG. 3. Alternately, adhesives may be used to interconnect these components. The tack welds 74 lend further structural integrity between the nozzle 30 and the top plate assembly 32. Around its perimeter, the steel sheathing 71 is bent to engage the side edges of the top plate 60, as may be seen in FIG. 3. A layer 75 of refractory mortar mechanically and sealingly connects the perimeter of the steel sheathing 71 to the side edges of the top plate 60.

As is best seen in FIG. 3, the recess 66 allows the bottom edge of the porous walls 34 of the nozzle 30 to extend a distance D that amounts to approximately 80% of the thickness T of the top plate 60. Such a downward extension of the porous walls 34 in turn allows bubbles 76 of argon gas flowing through the inner surface 42 of the nozzle 30 to form a protective film of gas along practically every point of the flow path of the molten steel from the receiving end 36 of the nozzle 30 to the discharge opening 64 in the top plate 60, the only exception being the relatively small length L of the discharge opening 64 of the insert 62. It is, of course, possible in theory to extend the annular shoulder 41*d* of the discharge end 40 of the nozzle 30 completely through the top plate 60 so that its bottom edge were completely flush with the bottom surface 103 of the top plate 60. However, such a design would not be compatible with a nozzle formed from porous magnesia. Such a design would result in the bottom edge of the discharge end 40 of the nozzle 30 becoming one of the two control surfaces in the action of the slide gate valve 3 (the other control surface being, of course, the throttle opening 10 of the throttle plate 8). As the porous magnesia that forms the walls 34 of the nozzle is not as erosion resistant to the flow of molten steel that the zirconia that forms the insert 62 is, the discharge end 40 of the nozzle 30 would not provide a control surface whose dimensions (and hence flow characteristics) remain substantially invariant during an operational run of the slide gate valve 3. Accordingly, the inventive design developed by the applicants extends the discharge end 40 approximately 80% through the thickness of the top plate 60, which substantially retards the accumulation of alumina deposits on the wall of the discharge opening 64 while leaving a sufficient thickness of the zirconia insert 62 in this region to provide a reliable, erosion-resistant, valve control surface.

With reference now to FIGS. 2 and 4, the unitized nozzle and top plate assembly 1 of the invention further includes a system 77 for conducting inert gas not only to the porous walls 34 of the nozzle 30 but also to the space between the bottom surface of the top plate 60 and the upper surface of the throttle plate 8. To this end, the gas system 77 includes a pipe section 79 that fits into a semicircular groove 80 in the sheathing 71 that in turns overlies a complimentarily-shaped groove 81 on the top surface of the top plate 60. The end of the pipe section 79 closest to the tubular steel wall 52 surrounding the nozzle 30 is mechanically and fluidly joined to an opening in the wall 52 by means of a weld joint 82, while the opposite end of the pipe section 79 includes a female thread 83. The female thread 83 forms a coupling 85 with the male thread 87 of one of the legs 88*a* of a bifurcated pipe joint 89 as shown. The bifurcated pipe joint 89 is in turn connected to the outlet hose 91 of a source 93 of pressurized, inert gas such as argon by means of a coupling 95. The pressure and flow rate of the argon gas entering the pipe section 79 is regulated by valve 95.5, while the pressure and flow rate of the argon gas entering pipe coupling 97 is regulated by a separate valve 95.6. The provision of a section of pipe 79 between the female thread 83 and the tubular steel wall 52 that surrounds the nozzle 30 creates a protective thermal gradient between the steel wall 52 (which can obtain temperatures of over 1,800° F. during operation of the slide gate valve 3) and the female thread 83 such that the female thread 83 only reaches temperatures of approximately 600° F.–800° F. due to the thermal resistance of the carbon steel that forms the pipe section 79. At temperatures of 600° F.–800° F., the female thread 83 in the pipe coupling 85 does not expand away from the male thread 87 to an extent where a gas leakage condition occurs since the thermal gradient across the joint is virtually eliminated.

Figure 5:
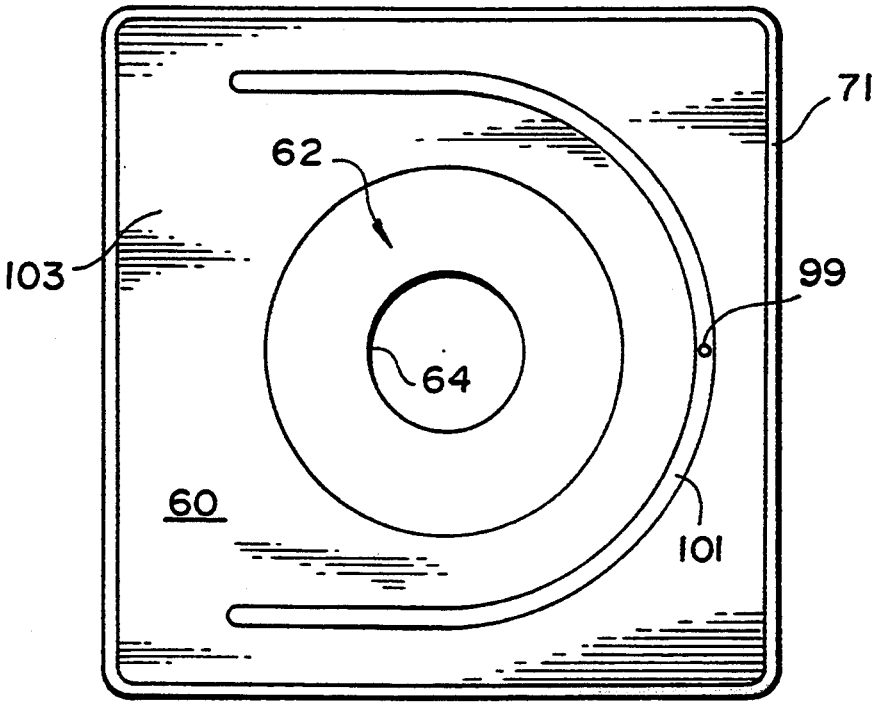
FIG. 5 is a bottom plan view of the top plate illustrated in FIG. 4.
Figure 6:
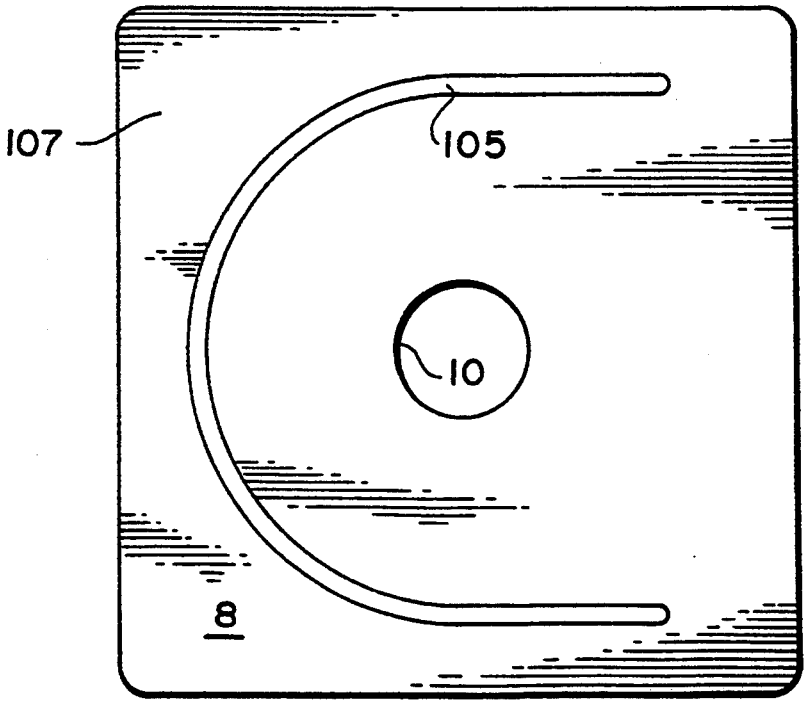
FIG. 6 is a top plan view of the throttle plate over which the top plate is mounted.

With reference now to FIGS. 2, 5 and 6, the inert gas system 77 also includes a second female thread 76 mechanically and fluidly joined to an opening in the steel sheathing 71 that surrounds the top surface and sides of the top plate 60. This female thread 96 forms a pipe coupling 97 with the male thread 98 of the other leg 88*b* of the bifurcated pipe joint 89. The opening in the steel sheathing 71 that the female thread 96 is joined to opens into a right-angled gas bore 99 that traverses the thickness of the plate 60. The right-angled gas bore terminates at its bottom end into a U-shaped, gas conducting groove 101 that surrounds most of the circumference of the discharge opening 64, as best seen in FIG. 5. The top surface 107 of the throttle plate 8 likewise includes U-shaped, gas-conducting groove 105 that is similar in shape to the gas-conducting groove 101 on the undersigned of the top plate 60, albeit oriented 180° in opposition to it. When the top plate 60 is stacked over the throttle plate 8 in the position illustrated in FIG. 1, the legs of the two U-shaped gas-conducting grooves 101 and 105 overlap one another to a greater or lesser extent, depending upon the position of the slidably-movable throttle plate 8 with respect to the top plate 60. Such overlapping of the legs of the two gas-conducting grooves 101 and 105 allows pressurized argon gas to continuously flow around the discharge opening 64 of the nozzle and the throttle opening 10 of the throttle plate 107 and further the space between the top plate 60 and throttle plate 8. The resulting flow of argon in turn effectively prevents any ambient air from contacting the molten steel at the interface between the throttle plate 8 and the top plate 60. Such displacement of all ambient air from this region prevents oxygen from contacting the molten steel in this region of the slide gate valve 3, thereby preventing the formation of oxides which could form undesirable inclusions in the finished steel product.

In the method of assembling the unitized nozzle and top plate assembly 1 of the invention into the slide gate valve 3, the entire assembly 1 is first conveniently pre-constructed at a site remote from the slide gate valve 3. Next the rockers 18*a, b* of the slide gate valve 3 are lowered, by the full removal of the slide gate mechanism, and the tube holder plate 12 and the throttle plate 8 are removed. The previously used nozzle, top plate and ramming material 24 are then removed by a skull dumping operation. Next, the unitized nozzle and top plate assembly 1 of the invention is raised underneath the openings in both the mounting plate 20 and tundish shell 22 until the refractory cloth 72 that overlies the steel sheathing 71 engages the lower surface of the mounting plate 20. New ramming material 24 is packed around the tubular, can-like steel wall 52 that surrounds the nozzle 30 into the arrangement illustrated in FIG. 1. The throttle plate and the tube holder plate 12 and the balance of the valve mechanism are placed back into their original positions and the rockers 18*a, b* are again upwardly biased to supply a vertical supporting force onto the underside of the tube holder plate 12. The two legs 88*a, b* of the bifurcated pipe joint 89 are then connected to the female threads 83 and 96 of the pipe couplings 85 and 97, and the coupling 95 is attached to the outlet hose of a pressurized gas source 93, whereupon the assembly method of the invention is concluded.

While this invention has been described with respect to a single, preferred embodiment, a number of design variations and alterations in both the apparatus and method of the invention will become evident to persons having ordinary skill in the art. All such variations and alterations are intended to be encompassed within the scope of this invention which is limited only by the claims appended hereto.

What is claimed:

1. A nozzle and top plate assembly for use in a slide gate mechanism, comprising:

a nozzle having walls formed substantially from a porous, gas permeable refractory material having a receiving end and a discharge end for receiving and discharging molten metal;

a top plate means formed from a non-porous refractory material having an opening through its thickness for regulating a flow of molten metal, and a top surface having a recess circumscribing said opening for receiving and securing said discharge end of said nozzle to said plate means, the depth of said recess being at least 50% of the thickness of the plate means to minimize contact between said molten metal and the surface of said plate opening, but no more than about 80% to provide a reliable valve-control surface, and means for providing pressurized inert gas through said porous walls of said nozzle.

2. The nozzle and top plate assembly of claim 1, wherein said means for providing said inert gas includes an integrally formed layer of gas impermeable material surrounding and partially spaced apart from the outside surface of the walls of said nozzle, and a source of pressurized inert gas in communication with a space defined between said layer and said outside nozzle walls.

3. The nozzle and top plate assembly of claim 2, wherein said means for providing inert gas further includes a conduit having one end in communication with said gas impermeable layer surrounding said outside nozzle walls, and another end including a coupling for connecting said conduit to said source of pressurized inert gas, wherein said conduit has sufficient thermal resistance to create a substantial thermal gradient between said material and said coupling.

4. The nozzle and top plate assembly of claim 3, wherein said upper surface of said top plate means includes a groove for receiving said conduit.

5. The nozzle and top plate assembly of claim 1, wherein the depth of said recess is at least 65% of the thickness of said top plate means.

6. The nozzle and top plate assembly of claim 1, wherein said nozzle includes an annular shoulder on its discharge end for extending the length of the porous walls toward a lower surface of said plate means.

7. The nozzle and top plate assembly of claim 2, wherein said means for providing pressurized inert gas further includes means for fluidly connecting said source of pressurized gas in a space between said top plate means and a throttle plate means to prevent ambient air from entering said space when molten metal flows between said top plate means and said throttle plate means.

8. The nozzle and top plate assembly of claim 7, wherein said means for fluidly connecting said source of pressurized gas in said space between said top plate means and throttle plate means includes gas conducting grooves on top and bottom surfaces of said top plate means, interconnected by a gas conducting passage traversing the thickness of said top plate means.

9. The nozzle and top plate assembly of claim 1, wherein said top plate means includes an insert formed from a refractory material more resistant to erosion from molten metal than the material forming the balance of said top plate means, and wherein said insert includes said opening.

10. The nozzle and top plate assembly of claim 2, wherein said layer covers and is adhered against edge portions of said top plate means.

11. A nozzle and top plate assembly for use in a slide gate mechanism, comprising:

a nozzle having walls formed substantially from a porous, gas conducting refractory material, said walls having an inside surface defining a bore, an outside surface, and a receiving end and a discharge end for receiving and discharging molten metal;

a top plate means formed from a non-porous refractory material having an opening through its thickness for regulating a flow of molten metal, and a top surface having a recess circumscribing said opening for receiving and securing said discharge end of said nozzle to said plate means, the depth of said recess being complementary in shape to said discharge end of said nozzle and extending at least 60% of the thickness of the plate means to minimize contact between said molten metal and the surface of said plate opening, but no more than about 80% to provide a reliable valve-control surface, and means for providing pressurized inert gas through said porous walls of said nozzle, including a layer of metallic gas impermeable sheet material surrounding and partially spaced away from said outside surface of said nozzle and extending substantially down to the discharge end of said nozzle, and a source of pressurized inert gas in communication with a space defined between said layer and said outside nozzle, and a conduit having one end in communication with said gas impermeable layer surrounding said outside nozzle walls, and another end including a coupling for connecting said conduit to said inert gas source, wherein said conduit creates a substantial thermal gradient between the temperature of the layer of material and the temperature of said coupling.

12. The nozzle and top plate assembly of claim 11, wherein the temperature of the end of said conduit that includes the coupling is half or less than the temperature of the end of said conduit connected to said gas impermeable layer.

13. The nozzle and top plate assembly of claim 11, wherein said recess is complementary in shape to the discharge end of said nozzle, and said metallic, gas impermeable layer of sheet material circumscribing said discharge end is sealingly and mechanically connected to the surface of said recess by a high temperature sealant.

14. The nozzle and top plate assembly of claim 11, wherein the depth of said recess is at least 65% of the thickness of said top plate means.

15. The nozzle and plate assembly of claim 11, wherein said nozzle includes an annular shoulder on its discharge end for extending the length of the porous walls toward a lower surface of said plate means.

16. The nozzle and top plate assembly of claim 11, wherein said means for providing pressurized inert gas further includes means for fluidly connecting said source of pressurized gas in a space between said top plate means and a throttle plate means to prevent ambient air from entering said space when molten metal flows between said top plate means and said throttle plate means.

17. The nozzle and top plate assembly of claim 16, wherein said means for fluidly connecting said source of pressurized gas in said space between said top plate means and throttle plate means includes gas conducting grooves on top and bottom surfaces of said top plate means, interconnected by a gas conducting passage traversing the thickness of said top plate means.

18. The nozzle and top plate assembly of claim 11, wherein said top plate means includes an insert formed from a refractory material more resistant to erosion from molten metal than the material forming the balance of said top plate means, and wherein said insert includes said opening.

19. The nozzle and top plate assembly of claim 18, wherein said insert is formed from zirconia.

20. The nozzle and top plate assembly of claim 11, further including a sheath of sheet metal covering the top surface of the top plate means, the layer of sheet material surrounding said nozzle being connected to said sheath to enhance the mechanical connection between said nozzle and said top plate means.

21. The nozzle and top plate assembly of claim 19, wherein the balance of the top plate means is formed from alumina.

22. The nozzle and top plate assembly of claim 11, wherein the nozzle walls are formed from porous magnesia.

23. The nozzle and top plate assembly of claim 20, further comprising a sheet of padding material overlying said sheath of metal for providing a cushion between said sheath and an underside of a mounting plate.

24. The nozzle and top plate assembly of claim 11, wherein the profile of the nozzle is elliptical to minimize turbulence in the flow of molten metal therethrough.

25. A unitized nozzle and top plate assembly for a tundish slide gate mechanism, comprising:

a nozzle having walls formed substantially from a porous, gas permeable refractory material, said walls having an inside surface defining a bore, an outside surface, and a receiving end and a discharge end for receiving and discharging molten metal;

a top plate means formed from a non-porous refractory material having an opening through its thickness for regulating a flow of molten metal, and a top surface having a recess circumscribing said opening for receiving and securing said discharge end of said nozzle to said plate means, the depth of said recess being complementary in shape to said discharge end of said nozzle and extending at least 65% of the thickness of the plate means to minimize contact between said molten metal and the surface of said plate opening, but no more than about 80% to provide a reliable valve-control surface;

means for providing pressurized inert gas through said porous walls of said nozzle, including a layer of metallic gas impermeable sheet material surrounding and partially spaced away from said outside surface of said nozzle and extending substantially down to the discharge end of said nozzle, and a source of pressurized inert gas in communication with a space defined between said layer and said outside nozzle, and a conduit having one end in communication with said gas impermeable layer surrounding said outside nozzle walls, and another end including a coupling for connecting said conduit to said inert gas source, wherein said conduit creates a substantial thermal gradient between the temperature of the layer of material and the temperature of said coupling, and a high temperature sealant joint for unitizing said nozzle and said top plate means, said joint being disposed between said gas impermeable layer of metallic sheet material circumscribing said discharge end and the surface of said complementary-shaped recess to fluidly seal and mechanically connect said nozzle and top plate means.

26. A method for assembling a gas permeable nozzle and a top plate within a tundish slide gate mechanism, comprising the steps of:

providing a nozzle having walls formed substantially from a porous, gas permeable refractory material, said walls having an inside surface defining a bore, an outside surface, and a receiving end and a discharge end for receiving and discharging molten metal;

surrounding the outside surface of said nozzle walls with a layer of metallic, gas impermeable sheet material that extends down to the discharge end of said nozzle, and fluidly sealing top and bottom edges of said sheet material to the receiving and discharging ends of the nozzle, respectively;

providing a top plate means formed from a non-porous refractory material having an opening through its thickness for regulating a flow of molten metal;

forming a recess around the opening in the top plate means that is complementary in shape to the discharge end of said nozzle, said recess having a depth of a least 50% of the thickness of said top plate means, but no more than about 80% of said thickness;

fluidly sealing and mechanically joining the discharge end of said nozzle to the complementary shaped recess in the top plate means by means of a high temperature sealant to unitize said nozzle and top plate means, said sealing and joining step being conducted at a location remote from a slide gate mechanism, and installing the unitized nozzle and top plate means into a slide gate mechanism.

* * * * *